US006626126B1

(12) United States Patent
Kalve

(10) Patent No.: US 6,626,126 B1
(45) Date of Patent: Sep. 30, 2003

(54) DAVIT DEVICE

(75) Inventor: Atle Kalve, Hordvik (NO)

(73) Assignee: Vestdavit AS, Bergen (NO)

( * ) Notice: Subject to any disclaimer, the term of this patent is extended or adjusted under 35 U.S.C. 154(b) by 0 days.

(21) Appl. No.: 10/181,050

(22) PCT Filed: Jan. 13, 2000

(86) PCT No.: PCT/NO00/00010

§ 371 (c)(1),
(2), (4) Date: Aug. 19, 2002

(87) PCT Pub. No.: WO01/51348

PCT Pub. Date: Jul. 19, 2001

(51) Int. Cl.[7] ..... B63B 23/02
(52) U.S. Cl. ..... 114/368
(58) Field of Search ..... 114/365, 368, 114/369

(56) References Cited

U.S. PATENT DOCUMENTS 3,137,013 A * 6/1964 Davenport ..... 114/369
3,729,941 A * 5/1973 Rochelle ..... 405/169

FOREIGN PATENT DOCUMENTS

DE 952870 C * 11/1956
GB 2186547 A * 8/1987

* cited by examiner

*Primary Examiner*—Stephen Avila
(74) *Attorney, Agent, or Firm*—Francis C. Hand; Carella, Byrne, Bain et al.

(57) ABSTRACT

A davit device (20) is arranged suspended over an associated boat (123) onboard a ship (25) or similar vessel. Horizontally, telescopically displaceable davit arms (121, 121) can move the boat (123) from a parking position to a launching position, and vice versa, while a hoisting device (122) can move the boat (23, 123) vertically. In that the hoisting device (122) is secure to the radially innermost, axially extendable telescope part (121*a*, 121*a*) of the davit arms (121,121), the vertical and horizontal movements can be carried out independently, in a controlled way.

3 Claims, 7 Drawing Sheets

121
24
121
122
120
123
P
25
26

24
121a
121b 130
130b
130a
131
25
123
P
26
25a

DAVIT DEVICE

The present invention relates to a davit device, which is arranged suspended over an associated boat on board a ship or vessel, comprising one or a couple of horizontally telescopically displaceable davit arm(s) for movement of the boat from a parking position to a launch position, and vice versa, including hoisting devices for lowering and hoisting of the boat.

According to known methods, many practical advantages are gained by arranging the davit device suspended at a height above the deck of the ship and the associated boat, i.e. suspended over and in its entirety at a height above the boat. Thereby, the davit device can be placed on the ship without requiring much space.

In particular, it is an advantage to arrange the davit device at a height substantially above the deck of the ship, so that it is possible to secure a relatively free deck space under the davit device. Thereby, deck space is freed. When the boat takes up its parking position, one can, for example, ensure relatively free passage for people at a level under the davit device, or under the boat itself, respectively, in those cases where this will be relevant.

However, with known embodiments of a davit device of the above mentioned type, it is common to arrange the hoisting devices, i.e. the winch itself and associated hoisting equipment, stationary on the deck of the ship or stationary at a certain height above the deck of the ship, such that the hoisting devices are easily accessible for manual operation from the deck of the ship.

However, such a manual, easily operated arrangement takes up considerable space on the deck area and, in addition, complicates the handling of the boat when it is launched or taken in. In such an arrangement, the hoisting devices must generally be guided in synchrony with the telescopic movements of the davit device. To be more precise, the pulling in and taking out of the hoisting line is guided in step with the telescopic movements of the davit device during launching and hoisting in of the boat, respectively, i.e. during horizontal movement of the boat with respect to the ship. In other words, during the telescopic pushing out and pushing in, respectively, of the davit arm(s), one must provide an equivalent lengthwise compensation in the hoisting line itself and then with a full weight load from the boat in the hoisting line.

One aims with the present invention, to avoid the above mentioned complications.

The davit device according to the invention is characterised in that the hoisting devices are securely fastened to the radially, innermost, axially extendable telescope part of the davit arm/davit arms, by way of one, or a set of, carrier arms which can be moved in a groove in a stationary secured telescope part.

Thus, it is possible to simplify the control of the different movements, which the boat will be subjected to, by moving the hoisting device together with the innermost, axially extendable telescope part of the davit arm/davit arms. Thereby, one can, in a safe and controlled way, displace both the boat and the hoisting device horizontally—by way of one simple telescopic davit arm, by way of a pair of telescopic davit arms, respectively, and thus hoist and lower the boat with regard to the ship with controlled movements of the hoisting line, independent of the movements of the davit arm/arms.

Further features will become apparent from the subsequent description with reference to the enclosed drawings, which show two relevant examples of embodiments of the use of the davit device in connection with a working boat an a lifeboat respectively, in which.

Figure 1:
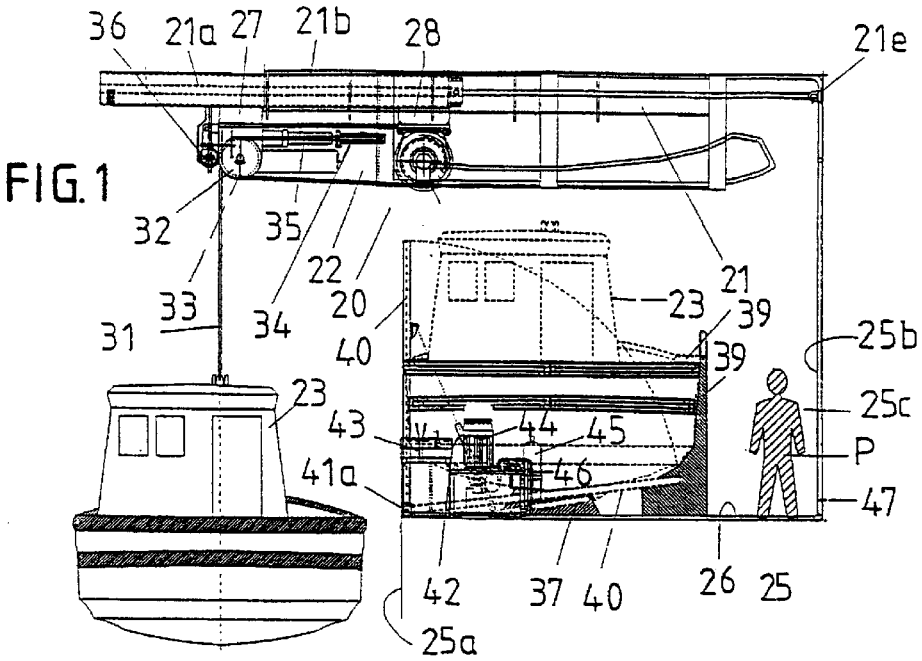
FIG. 1 shows a single davit arm according to the invention in first embodiment in connection with a single wire hoisting device for handling of a working boat, which is shown in side view, with unbroken lines in a launching position and shown with broken lines in a parking position.
Figure 2:
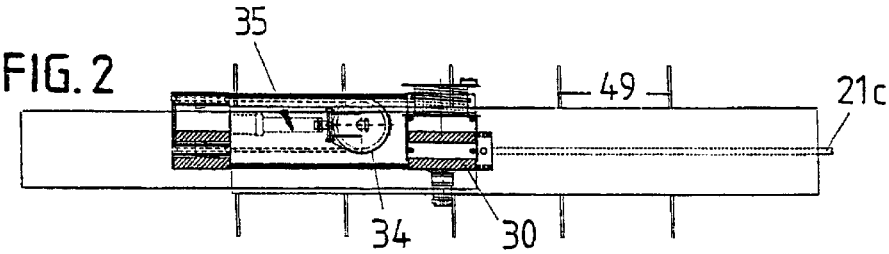
FIG. 2 shows the davit arm viewed from below and with certain parts hown in horizontal section.

According to a first embodiment example, as is shown in FIGS. 1–6, a davit device 20 is shown with one single davit arm 21. A single-wire hoisting device 22 is used for handling of, i.e. for hoisting and lowering, respectively, a boat 23 of the type working boat or so called MOB-boat (man-overboard-boat).

The davit device 20 according to the invention is shown in form of a continuous unit of davit arm 21 and hoisting device 22. The continuous unit is shown in a way that is not space demanding, in a suspended position underneath an overhanging deck or a similar roof-forming carrier construction 24 onboard a ship 25.

The davit arm 21 is comprised of a radially innermost telescope part 21*a*, which can be moved axially with respect to a radially outermost telescope part 21*b*. The telescope part 21*b* is shown secured directly to the overhanging deck or similar roof-forming carrier construction 24.

The davit arm 21 with associated hoisting device 22 is shown in the drawings suspended at a substantial height over the ship's 25 deck 26, which lies below, so that the space under the davit device 20 is easier to access for free passage.

The hoisting device 22 is secured directly to the radially innermost telescope part 21*a* by way of a couple of carrier arms 27, 28 (see FIGS. 1 and 3), which run through the downward opening slot 29 (see FIGS. 4–6) in the radially outermost telescope part 21*b*.

The hoisting device 22 is comprised of a hydraulically driven hoisting winch 30 with associated single running hoisting wire 31. The hoisting wire 31 (see FIGS. 5 and 6) runs from the hoisting winch 30 over a first pulley 32 to a second pulley 33 by way of an intermediate pulley 34 in a tension-type shock-absorbing device 35. At 36 (see FIGS. 5 and 6) a support roll is shown to support the hoisting wire 31 in its position with respect to the pulleys 32, 33.

In FIG. 1, the boat 23 is shown with dotted lines in parking position, resting on the deck 26 of the ship 25 by way of a horizontal keel-support 37 and a couple of vertical side-supports 38 on the side facing the ship. The side-supports 38 are equipped on top with locking bodies 39 which are pivotable, for locking of the boat in place in the parking position.

In FIG. 1 the boat 23 is shown with full lines in a launching position, hanging in the hoisting-wire 31 immediately outside the outer side 25*a* of the ship 25, made ready for boarding from the deck 26 of the ship.

With dotted lines in FIG. 1, a couple of slides 40 are shown, which in the boat's parking position are placed on the underside 23 of the boat and which in the launching position of the boat 25 (shown by the full lines) are shown rotated to a vertical position aligned with the outer side of the ship 25. Thereby, in an itself known way, the boat 23 can, during launching and hoisting respectively, be guided in a gliding facility against the slides and outer side of the ship 25, respectively, according to need. The slides 40 can rotate around a horizontal axis 41*a* at the outer side 25*a* of the ship 25, i.e. along the edge of the deck 26 of the ship 25, with the aid of individually associated corresponding hydraulic cylinders 42.

Between a bulkhead 25*b* of a ship and the side-supports 38, a passage 25*c* is shown for a person P at a level essentially underneath the davit arm 21 and the hoisting device 22.

At the edge of the deck 26 of the ship 25, a service-space for launching/pulling in of the boat is shown. Also shown is a manoeuvre valve 43 with associated hydraulic engine 44, pressure-accumulator 45 and connecting lines 46. A protective tube 47 with internal lines 47*a*–47*d* runs from the service space by way of the deck 26 and the bulkhead 25*b* of the ship to the overhanging deck 24 and further on by way of the flexible lines 47*a*–47*d* to the internal telescope part 21*a* of the davit arm 21. From the telescope part 21*a*, the lines 47*a*–47*d* branch off to the hoisting winch 30 and to a pressure cylinder 21*c* respectively (not shown in detail) to the tension-type shock-absorbing device 35. A piston rod 21*d*, which has one end fastened to a piston (not shown) in the pressure cylinder 21*c*, has its opposite end fixed to the bulkhead 25*b* of the ship (see FIG. 6) in a fitting 21*e*.

With the help of the manoeuvre valve 43, one can in succession and each in turn:

- hoist the boat 23 from the keel-support 37 by way of the hoisting winch 30,
- displace the boat 23 and the hoisting device 22 horizontally by way of the pressure cylinder 21*c* of the davit arm 21 from a position over the deck 26 of the ship 25 to a position outside the outer side 25*a* of the ship, and thereafter
- lower the boat 23, for example to the position which is shown by the full lines in FIG. 1.

The above-mentioned movements can be carried out in turn and individually, i.e. in a controlled way with mutually independent movements. The vertical movements of the boat are carried out from the hoisting winch 39 in the movable telescope part 21*a* of the davit arm 21, while the horizontal movements of the boat are carried out by pushing out and pushing in, respectively, of the movable telescope part 21*a* of the davit arm 21 with respect to the stationary telescope part 21*b* of the davit arm 21, i.e. by simultaneous horizontal displacement of the boat 23 and the hoisting device 22.

After boarding the boat 23, the manoeuvre.valve 43 can, with the help of in itself know components, be remote controlled from the boat 23 for further lowering of the boat to the sea surface. In the same way, the boat 23 can, in a subsequent phase after use of the boat, after hooking a securing hook to the hoisting line 31, be hoisted onboard again with the equivalent remote control of the manoeuvre valve 43.

Figure 3:
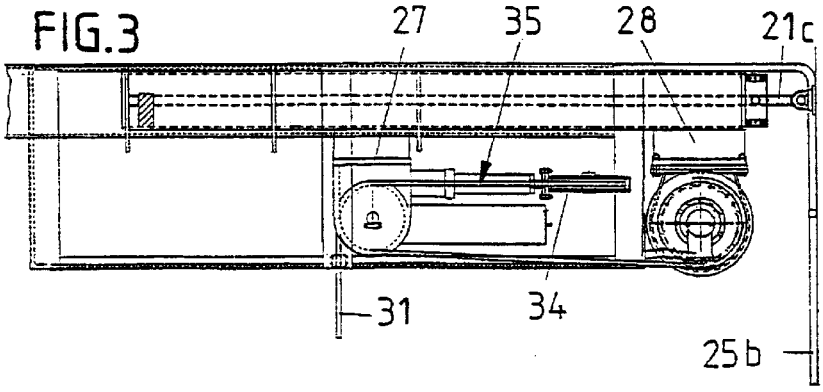
FIG. 3 show the davit device in section, shown partly in side view and partly in vertical section.
Figure 4:
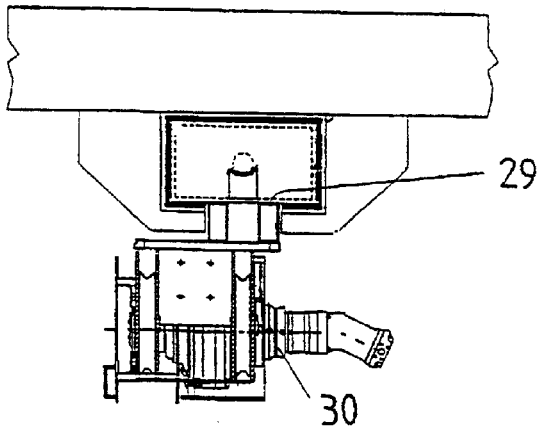
FIG. 4 shows a cross section of the davit device.
Figure 5:
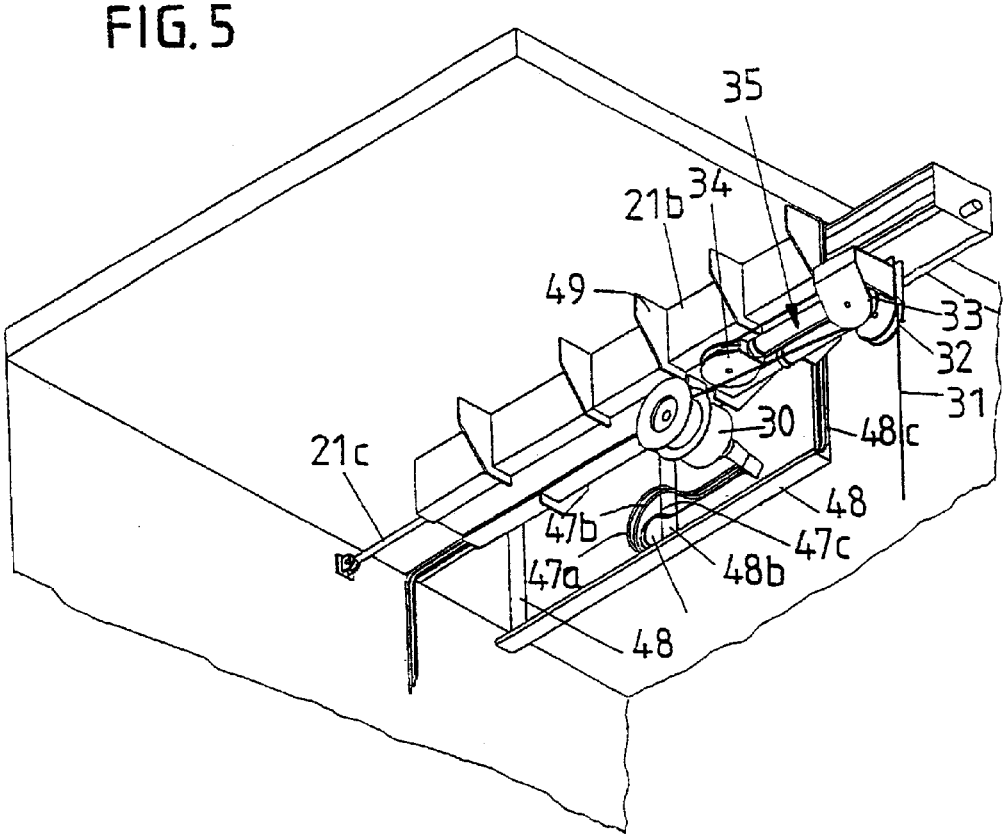
FIGS. 5 and 6 show the davit device separately in the parking position and launching position, respectively, of the boat.
Figure 6:
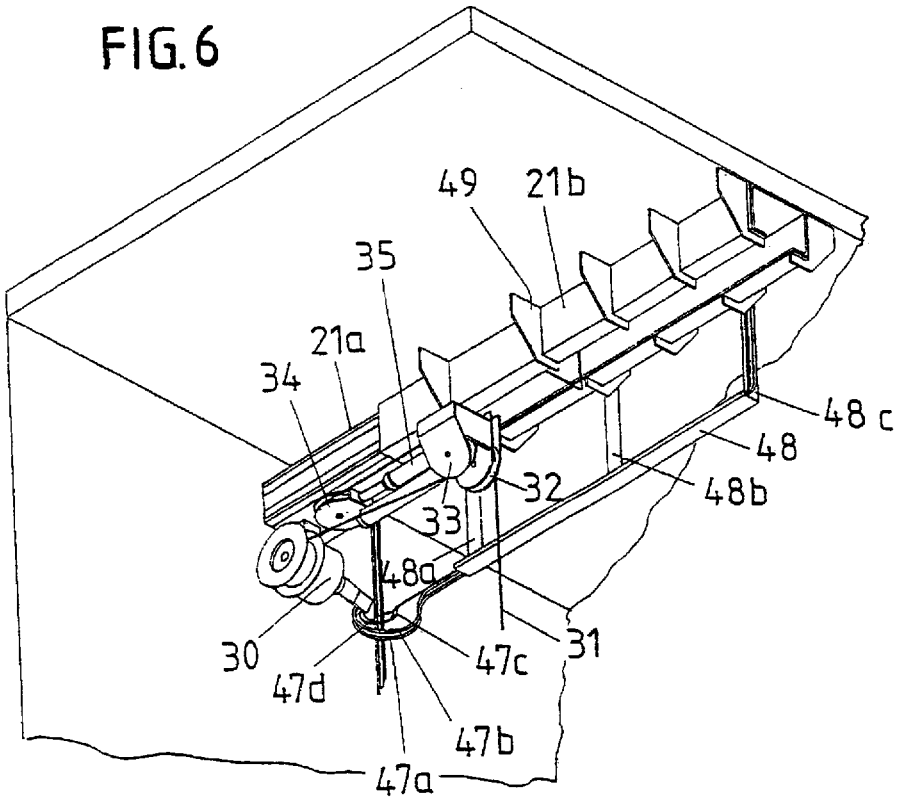

The davit arm 21 is shown in FIGS. 1 and 5 in an axially fully extended condition and in FIGS. 3 and 6, the davit arm 21 is shown in fully pulled in, i.e. retracted position.

In FIGS. 5 and 6, flexible lines are shown, i.e. pressure-oil lines 47*a*–47*d* in the opposite outer positions of the davit arm 21. The pressure-oil lines 47*a*–47*d* are supported on a rail 48, which are carried, by way of the vertical carrier-arms 48*a*–48*c*, in the outermost telescope part 21*b* of the davit arm 21.

The external telescope part 21*b* is, as it clearly can be seen in FIGS. 5 and 6, fitted with a series of transverse bracing plates 49, which in turn are rigidly connected to an overhanging deck or roof-forming construction 24.

According to another embodiment example, as shown in FIGS. 7–13, a davit device 120 is shown with a couple of mutually parallel davit arms 121, 121, which together carry and are mutually reinforced by way of an intermediate cross bar 121*d*. The cross bar 121*d* is used as a carrier body for a hoisting device 122 for handling of a boat 123 of the type lifeboat. In addition, the cross bar 121*d* is used as carrier body for the power unit of the hoisting device 122, etc.

The lifeboat 123 is carried, in the shown embodiment example, by the opposite ends in a double-wire hoisting line, i.e. with the aid of two separate wires 131, 131, which are handled by way of their own drum on a common winch 130.

Each of the davit arms 121 is comprised of a radially innermost telescope part 121*a*, which can be displaced axially with respect to a radially outermost telescope part 121*b*.

The radially outermost, i.e. the stationary, secured telescope part 121*b*, is (in a corresponding way as the stationary, secured telescope part 21*b* in the first embodiment example) secured to an overhanging roof-forming deck or similar carrier construction 24 onboard a ship 25 at a level considerably over the below lying deck 26 of the ship 25, which is shown.

In this embodiment example, the lifeboat 123 is shown in a parking position raised up from the deck 26, i.e. shown at a level which permits free passage for a person P on the underside of the lifeboat 123 itself. In this case, a hoisting device 122 and a corresponding power unit, including a manoeuvre valve 143 with associated hydraulic engine 144 with pressure-oil pump, pressure-accumulator 145 is and connecting lines 146, are secured directly to the cross bar 121*d* between the two mutually parallel davit arms 121 and the innermost telescope part 121*a*, respectively. Thereby, a substantial area of the deck 26 of the ship 25 under the lifeboat 123 is freed.

One aim is to achieve remote control of the manoeuvre valve from any position on the deck 26 of the ship 25 by means of in itself known equipment. This results in the whole deck area underneath and nearby the lifeboat being made available for free passage, as is illustrated by a person P in FIGS. 7 and 9.

Figure 7:
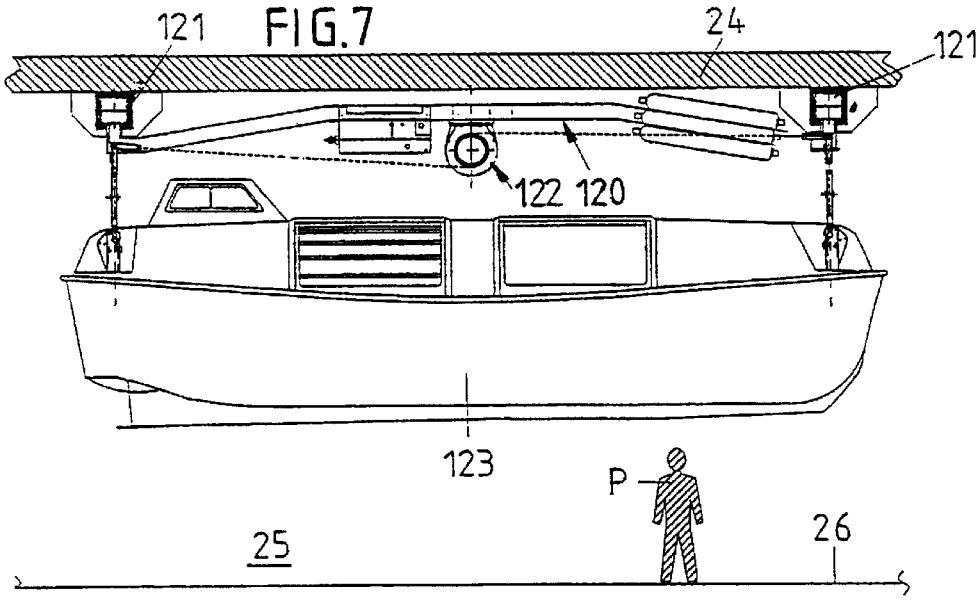
FIG. 7 shows, in side view, a davit device according to the invention in another embodiment in connection with a double-wire hoisting device for handling of a lifeboat, which is shown in a parking position.
Figure 8:
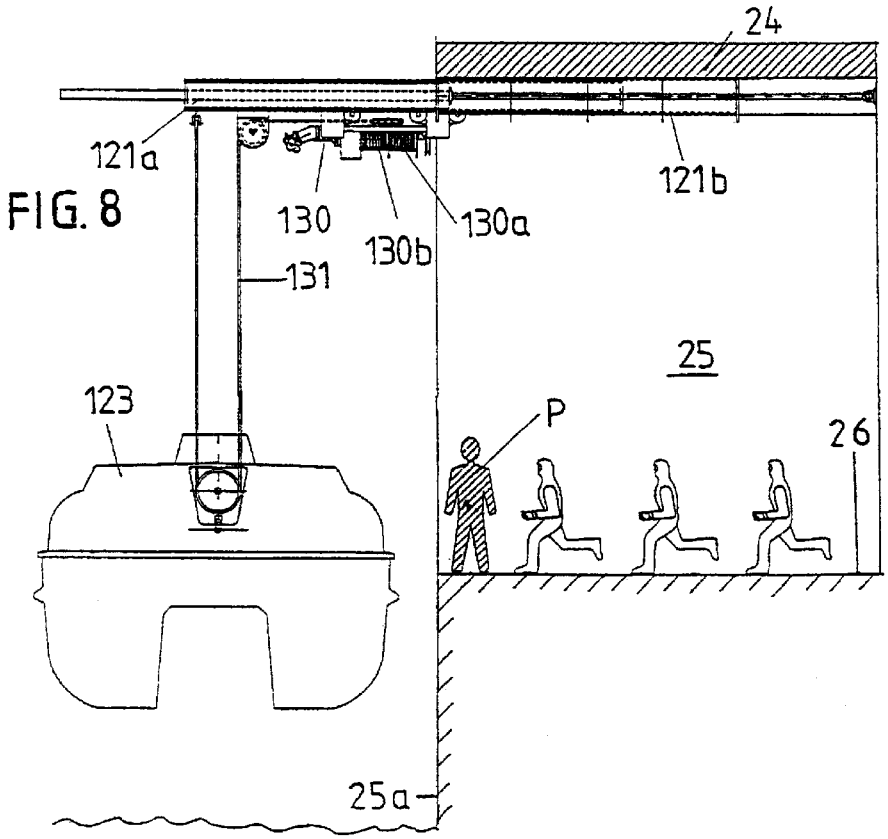
FIG. 8 shows, in side view, the same as is shown in FIG. 7, but shown in launching position.
Figure 9:
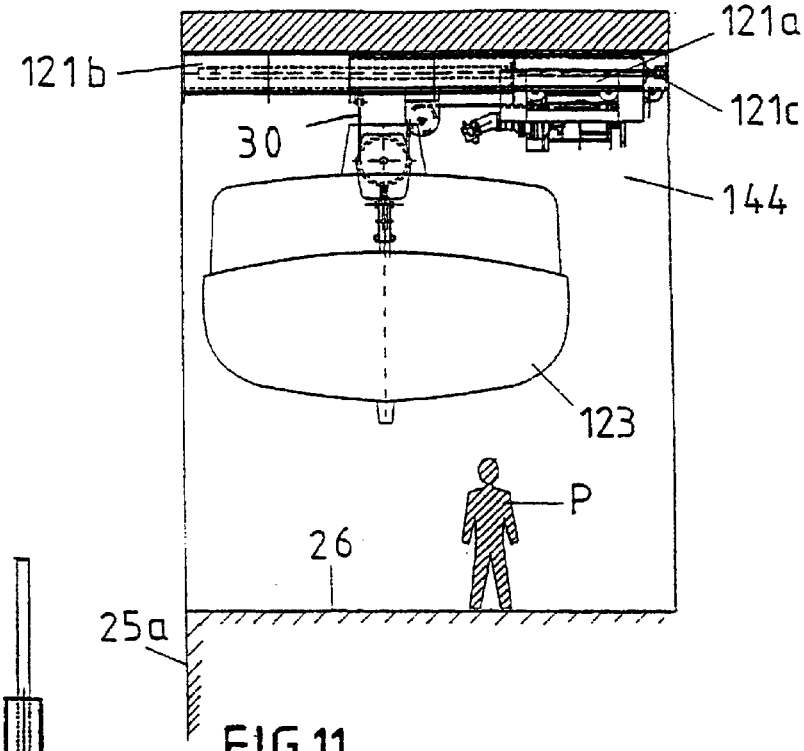
FIG. 9 shows, in an end view, the same as is shown in FIG. 7, but with certain parts shown in section.
Figure 11:
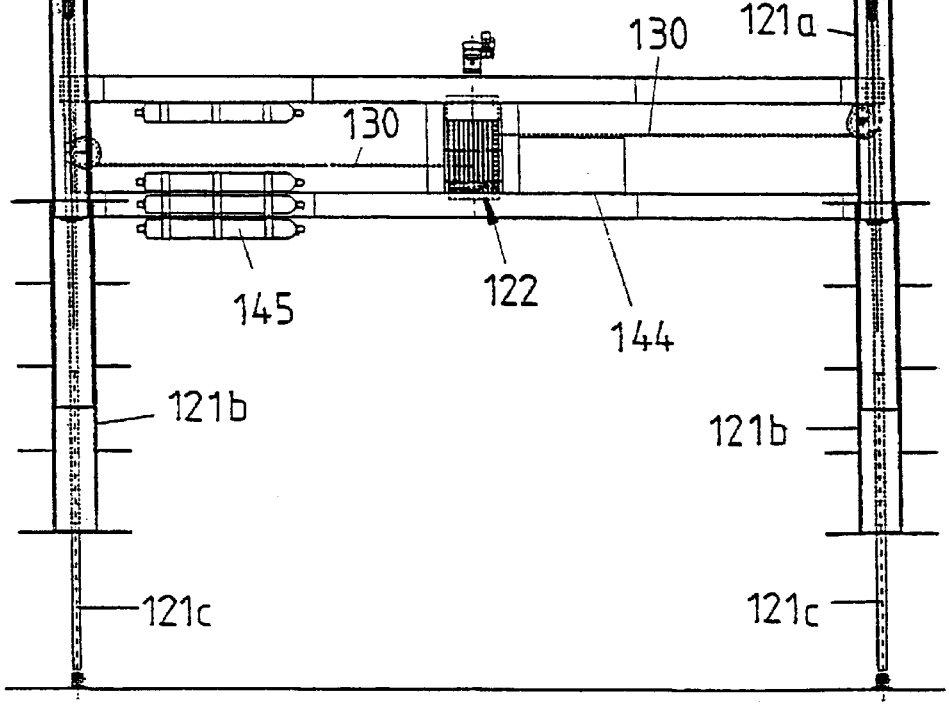
FIG. 11 shows the same as is shown in FIG. 10, without the lifeboat.
Figure 10:
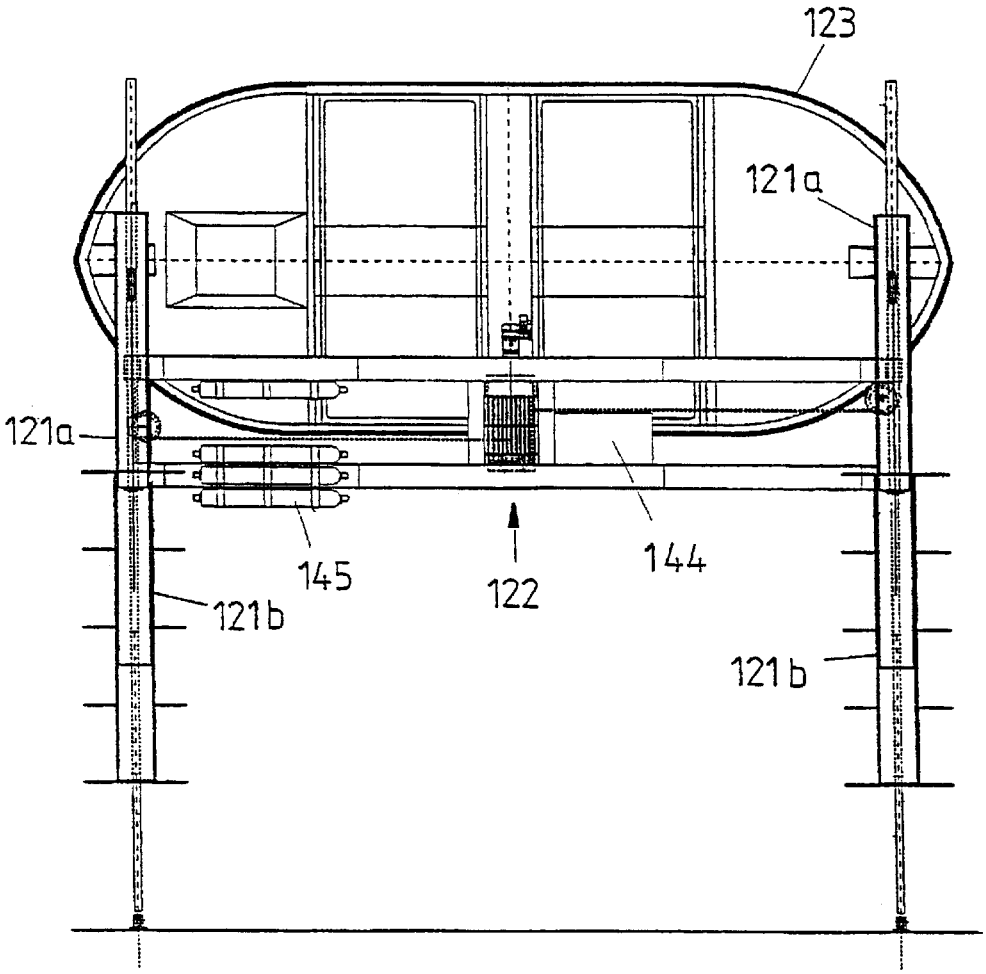
FIG. 10 shows, partly in plane view and partly in section, the same as is shown in FIG. 7, including the lifeboat.

In FIG. 8, the lifeboat 123 is shown after it is displaced sideways outwards from a parking position, as is shown in FIGS. 7 and 9, to a launching position outside the outer side 25*b* of the ship 25 by way of the davit arms 121, and thereafter, by way of the hoisting lines 131, is lowered down to boarding position, approximately aligned with the deck 26 of the ship 25.

The vertical and horizontal movements, which the lifeboat is subjected to, are carried out in a way corresponding to that of the first embodiment example.

Figure 12:
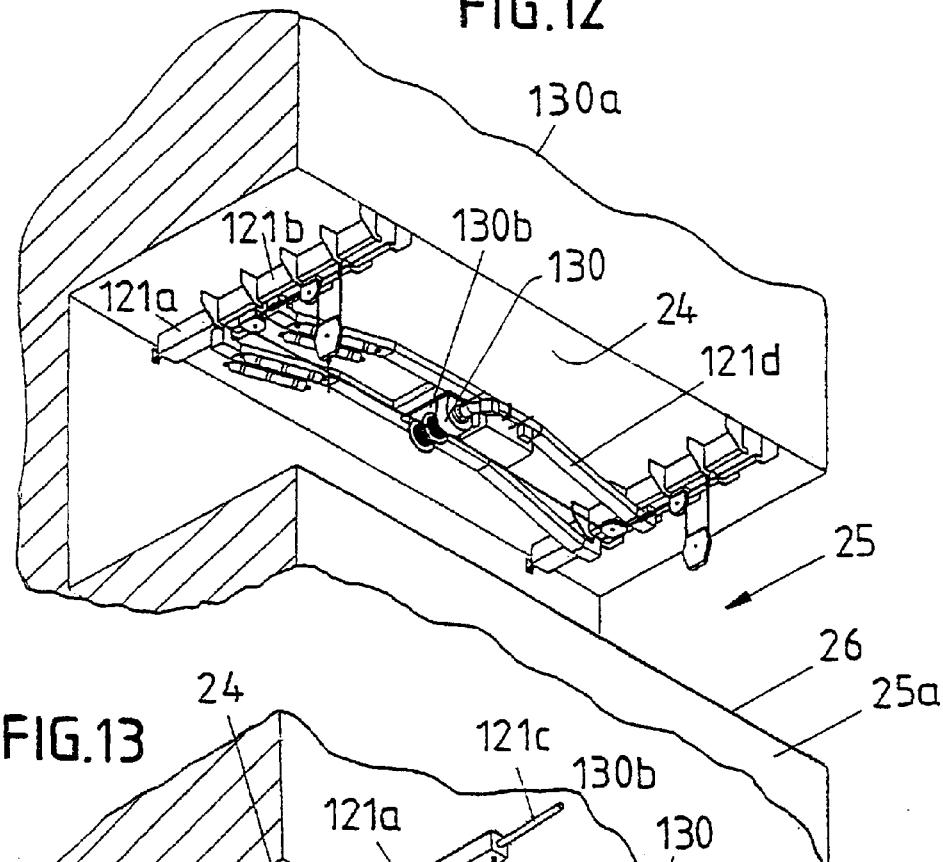
FIGS. 12 And 13 show, in perspective and partly in section, a section of the ship with associated davit device in parking and launching position, respectively.
Figure 13:
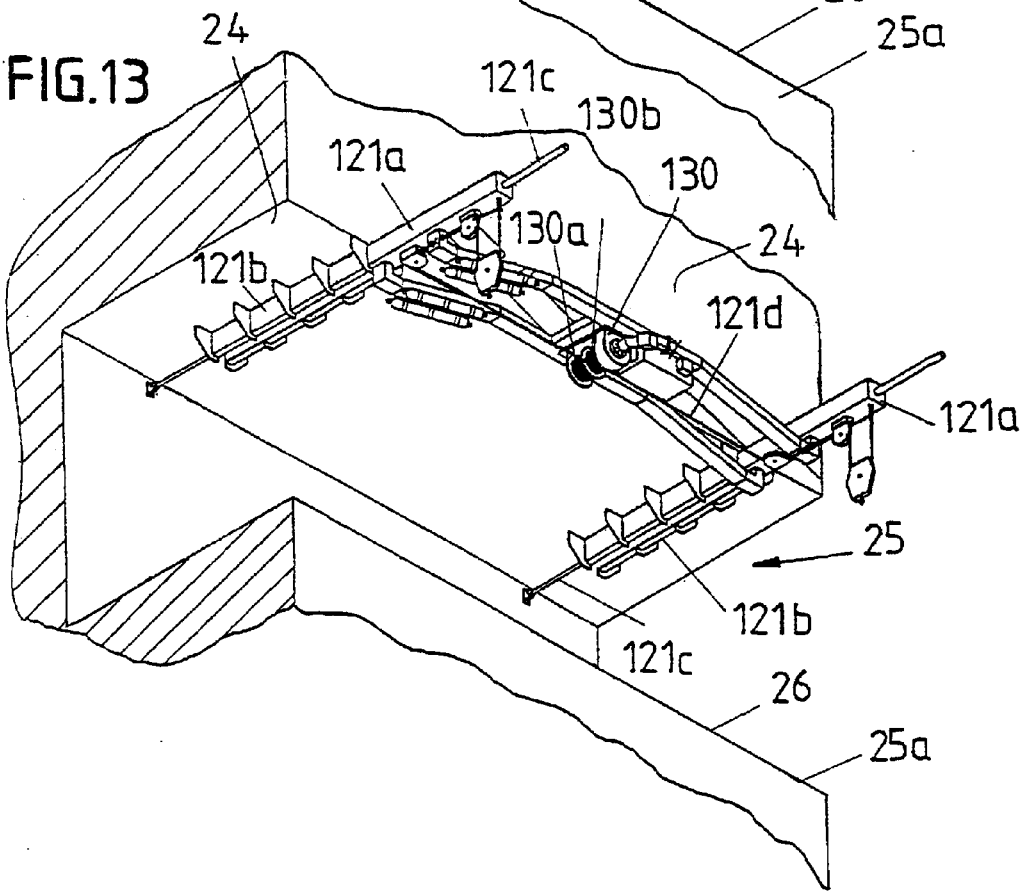

The davit arms 121, 121, which can be displaced telescopically, are shown in an axially retracted condition and axially extended condition in FIG. 12 and FIG. 13, respectively.

What is claimed is:

1. A davit device (20), which is arranged suspended over an associated boat (23, 123) onboard a ship (25) or similar vessel, incorporating horizontally telescopically displaceable davit arm(s) (21; 121,121) for moving of the boat (23, 123) from a parking position to a launching position, and vice versa, and hoisting devices (22, 122) for lowering and hoisting of the boat (23, 123), characterised in that the hoisting devices (22, 122) are securely fastened to the radially innermost axially displaceable telescope part (21*a*; 121*a*, 121*a*) of the davit arm/davit arms (21; 121, 121), by way of one or a set of carrier arms (27, 28), which are displaceable in a groove in a stationary, secured telescope part (21*b*; 121*b*, 121*b*).

2. The davit device in accordance with claim 1, cnaracterised in that the power unit (144, 145) of the hoisting device (122) and the manoeuvre valve (143) is arranged in a suspended position over the associated boat (123).

3. A davit device in accordance with claim 2, in which the davit device (120) includes two mutually parallel, telescopically displaceable davit arms (121) and an intermediate cross bar (121*d*) with a associated hoisting device (122), characterised in that the cross bar (121*d*) in addition to the carrier device for the hoisting device (122) form a carrier device for the power unit (144, 145) and the manoeuvre valve (143) with associated fittings.

* * * * *